US010663237B2

(12) United States Patent
Kim et al.

(10) Patent No.: US 10,663,237 B2
(45) Date of Patent: May 26, 2020

(54) HEAT TRANSFER TUBE HAVING SUPERHYDROPHOBIC SURFACE AND METHOD FOR MANUFACTURING THE SAME

(71) Applicants: DOOSAN HEAVY INDUSTRIES & CONSTRUCTION CO., LTD., Changwon-si, Gyeongsangnam-do (KR); University-Industry Cooperation Group of Kyung Hee University, Yongin-si, Gyeonggi-do (KR)

(72) Inventors: Jin Bum Kim, Yongin-si (KR); Hyun Sik Kim, Seoul (KR); Young Suk Nam, Seoul (KR); Kyoung Hwan Song, Seoul (KR); Seung Tae Oh, Hwaseong-si (KR); Jae Hwan Shim, Seongnam-si (KR); Dong Hyun Seo, Hwaseong-si (KR)

(73) Assignees: Doosan Heavy Industries Construction Co., Ltd., Gyeongsangnam-do (KR); UNIVERSITY-INDUSTRY COOPERATION GROUP OF KYUNG HEE UNIVERSITY, Gyeonggi-do (KR)

( * ) Notice: Subject to any disclaimer, the term of this patent is extended or adjusted under 35 U.S.C. 154(b) by 0 days.

(21) Appl. No.: 15/921,618

(22) Filed: Mar. 14, 2018

(65) Prior Publication Data

US 2018/0266776 A1 Sep. 20, 2018

(30) Foreign Application Priority Data

Mar. 15, 2017 (KR) ..... 10-2017-0032240

(51) Int. Cl.
*F28F 13/18* (2006.01)
*F22B 37/10* (2006.01)
(Continued)

(52) U.S. Cl.
CPC ..... *F28F 13/187* (2013.01); *B05D 5/083* (2013.01); *B05D 7/146* (2013.01); *C23C 22/05* (2013.01);
(Continued)

(58) Field of Classification Search
None
See application file for complete search history.

(56) References Cited

U.S. PATENT DOCUMENTS

2005/0243129 A1* 11/2005 Kim ..... B41J 2/14129 347/45
2013/0244001 A1* 9/2013 Wang ..... C23C 8/42 428/141
(Continued)

FOREIGN PATENT DOCUMENTS

DE 102008064125 A1 6/2010
EP 0226861 A1 7/1987
(Continued)

OTHER PUBLICATIONS

Korean Office Action issued by the Korean Intellectual Property Office dated Jul. 19, 2018 in connection with Korean Patent Application No. 10-2017-0032240.
(Continued)

*Primary Examiner* — Nathan T Leong
(74) *Attorney, Agent, or Firm* — Invenstone Patent, LLC

(57) ABSTRACT

The present disclosure relates to a heat transfer tube comprising nanostructures formed on the surface, and a method for manufacturing the same, and by forming nanostructures on a heat transfer tube surface, a superhydrophobic surface
(Continued)

may be obtained under a high temperature environment as well. In addition, superhydrophobicity may be enhanced by further forming a hydrophobic coating layer on the nanostructure-formed heat transfer tube surface. By using a method of forming nanostructures by dipping the heat transfer tube surface, complex shapes may be coated, and therefore, a plurality of assembled heat transfer tubes may be coated, and damages occurring during a process of assembling the heat transfer tube after coating may be prevented.

13 Claims, 13 Drawing Sheets

(51) Int. Cl.

| | |
|---|---|
| ***C23C 22/05*** | (2006.01) |
| ***B05D 5/08*** | (2006.01) |
| ***B05D 7/14*** | (2006.01) |
| *F28B 1/02* | (2006.01) |
| *B05D 1/18* | (2006.01) |
| *F28D 21/00* | (2006.01) |

(52) U.S. Cl.

CPC ..... *F22B 37/107* (2013.01); *B05D 1/18* (2013.01); *B05D 2202/00* (2013.01); *B05D 2254/02* (2013.01); *B05D 2506/00* (2013.01); *B05D 2518/12* (2013.01); *F28B 1/02* (2013.01); *F28D 2021/0063* (2013.01); *F28F 2245/04* (2013.01); *F28F 2255/20* (2013.01)

(56) References Cited

U.S. PATENT DOCUMENTS

| | | | | |
|---|---|---|---|---|
| 2014/0182790 | A1* | 7/2014 | Hwang ..... | C25D 11/04 159/28.1 |
| 2017/0010060 | A1 | 1/2017 | Chang et al. | |

FOREIGN PATENT DOCUMENTS

| | | | |
|---|---|---|---|
| EP | 2476990 | A2 | 7/2012 |
| JP | H06-265292 | A | 9/1994 |
| JP | 2000-154986 | A | 6/2000 |
| JP | 2001-304786 | A | 10/2001 |
| JP | 2010-125485 | A | 6/2010 |
| JP | 2013-120047 | A | 6/2013 |
| JP | 2016-510252 | A | 4/2016 |
| JP | 2016-516100 | A | 6/2016 |
| KR | 10-2014-0033084 | A | 3/2014 |
| KR | 10-1479448 | B1 | 1/2015 |
| KR | 10-2016-0001365 | A | 1/2016 |
| KR | 1020160001365 | * | 1/2016 |
| WO | 2004/113456 | A2 | 12/2004 |

OTHER PUBLICATIONS

An European Search Report dated Oct. 10, 2018 in connection with European Patent Application No. 18161729.1 which corresponds to the above-referenced U.S. application.

* cited by examiner

HEAT TRANSFER TUBE HAVING SUPERHYDROPHOBIC SURFACE AND METHOD FOR MANUFACTURING THE SAME

CROSS-REFERENCE(S) TO RELATED APPLICATIONS

This application claims priority to Korean Patent Application No. 10-2017-0032240, filed on Mar. 15, 2017, the disclosure of which is incorporated herein by reference in its entirety.

BACKGROUND OF THE DISCLOSURE

Field of the Disclosure

The present disclosure relates to a heat transfer tube comprising a superhydrophobic surface, and a method for manufacturing the same, and in particular, to the heat transfer tube comprising the superhydrophobic surface by forming nanostructures on a surface of the heat transfer tube or further forming a hydrophobic coating layer, and a method for manufacturing the same.

Description of the Related Art

In nuclear power plants or thermoelectric power plants, heat is generated with uranium, petroleum or coal as a fuel, and steam is formed by heating water circulating the system using this heat. The formed steam produces electricity by operating a turbine, and the steam passing through the turbine is cooled in a condenser and changed again into water. Particularly, a water cooling method of cooling the condensation process using water in a steam circulating power generation methods requires large quantities of cooling water, and seawater is used as the cooling water used in the condenser. Accordingly, the plants are generally built near the coast in order to smoothly supply and discharge the seawater used as the cooling water.

The condenser is also expressed as a steam condenser, and by continuously flowing seawater in a condenser heat transfer tube, a temperature of the inner wall of the condenser is continuously lowered. Then, water vapor coming out through the valve and operated by the turbine is run right against the inner wall of the condenser, and at the moment, the water vapor becomes a condensate, and the condensate is sent back to a boiler pipe to become water of approximately 500 degrees Celsius and pass the turbine through the valve.

The process of hot water becoming supersaturated steam and continuously spurting from the turbine through the value in the boiler, and the steam quickly cooling to become water in the steam condenser is continuously repeated.

Herein, as for the cooling water cooling the outer wall of the condenser, a large quantity of it is required beyond compare with cooling water cooling frictional heat of machines, and seawater needs to be continuously supplied while operating the generator.

By bringing the turbine-operated water vapor into contact with the inner wall of the condenser, the water vapor is cooled and goes back to water, and herein, in order to increase the amount of contact with the inner wall of the condenser, a plurality of heat transfer tubes are formed.

SUMMARY OF THE DISCLOSURE

However, the condenser has a problem of causing corrosion due to condensation outside the heat transfer tubes, when the corrosion is generated by a condensed fluid remaining on the surface. Likewise, in a heat exchanger used in the power plants, the corrosion formed due to condensation outside the tube or a condensed fluid remaining on the surface may also occur during a heat exchange between flow paths through a heat transfer plate.

In order to prevent such a problem, a crosslinked hydrophobic film is utilized, where the crosslinked hydrophobic film contains a resin comprising a fluorine atom-containing group, a quaternary ammonium salt group-containing modified epoxy resin and an amino resin. However, the hydrophobic film has problems in that it becomes difficult to form a superhydrophobic film having a contact angle of 150 degrees or larger between the surface and the water drop and to maintain hydrophobic coating under a high temperature environment.

In addition, in order to form such a superhydrophobic film, a coating solution has been applied using a roll coater method or the like. Because the condenser has the plurality of heat transfer tubes assembled, each of the heat transfer tubes needs to be coated and assembled in order to form a hydrophobic coating layer.

However, the individual coating of the plurality of heat transfer tubes may be inconvenient, and the hydrophobic coating layer may come off during the assembly of the coated heat transfer tubes.

In view of the above, the improved technology of having superhydrophobicity on the surface of the heat transfer tubes under a high temperature environment as well as simplifying the manufacturing process thereof has been sought after.

Accordingly, the present disclosure relates to a heat transfer tube comprising a superhydrophobic surface, and a method for manufacturing the same.

The present disclosure is directed to providing a heat transfer tube capable of comprising a superhydrophobic surface under a high temperature environment as well by forming nanostructures on a surface of the heat transfer tube.

The present disclosure is also directed to providing a manufacturing method of forming nanostructures by dipping a plurality of assembled heat transfer tubes and forming a hydrophobic coating layer, and capable of preventing damages that may occur during the process of forming nanostructures on the surface of the heat transfer tube and assembling the heat transfer tube thereafter.

The present disclosure is also directed to providing a heat transfer tube comprising enhanced hydrophobicity by further forming a hydrophobic coating layer on a heat transfer tube with nanostructures formed on the surface.

Other objects and advantages of the present disclosure will become clearer by detailed descriptions of the disclosure and claims provided below.

Embodiments of the present disclosure are provided in order to more fully describe the present disclosure to those comprising common knowledge in the art. The following embodiments may be modified to various different forms, and the scope of the present disclosure is not limited to the following embodiments. These embodiments are provided in order to make the present disclosure fuller and more complete, and to completely transfer ideas of the present disclosure to those skilled in the art.

In addition, a thickness or a size of each layer in the drawings may be exaggerated for the convenience of description or clarity, and like reference numerals designate like constituents in the drawings. As used in the present specification, the term "and/or" comprises any one and all combinations of one or more of the corresponding items listed.

Terms used in the present specification are used for describing specific embodiments and are not to limit the present disclosure. As used in the present specification, a singular form may comprise a plural form unless clearly indicating otherwise in the context. In addition, when used in the present specification, "include(comprise)" and/or "including(comprising)" specify the presence of mentioned shapes, numbers, steps, operations, members, constituents and/or groups thereof, and does not exclude presence or addition of one or more other shapes, numbers, operations, members, constituents and/or groups.

A heat transfer tube of the present disclosure means, like a flow path of a heat exchanger, a heat transfer tube that may be comprised in condensation related equipment in fields such as power plants, freshwater technologies and water harvesting as well as a heat transfer tube forming a condenser.

As one specific embodiment of the present disclosure, the present disclosure relates to a method for manufacturing a heat transfer tube comprising a superhydrophobic surface comprising 1) ultrasonicating a heat transfer tube using an organic solvent; 2) washing the ultrasonicated heat transfer tube of 1); 3) removing a metal oxide on a surface of the heat transfer tube by dipping the washed heat transfer tube of 2) into an acidic solution; 4) preparing a dipping solution for forming nanostructures; and 5) dipping the metal oxide-removed heat transfer tube of 3) into the dipping solution for forming nanostructures of 4).

As one specific embodiment of the present disclosure, the dipping solution for forming nanostructures of the present disclosure may comprise water; $NaClO_2$; NaOH; and $Na_3PO_4$.

As one specific embodiment of the present disclosure, the dipping solution for forming nanostructures of the present disclosure may comprise the $NaClO_2$ in 1 parts by weight to 4 parts by weight; the NaOH in 3.5 parts by weight to 10 parts by weight; and the $Na_3PO_4$ in 5 parts by weight to 11 parts by weight with respect to 100 parts by weight of the water.

As one specific embodiment of the present disclosure, 5) of the present disclosure may dip the heat transfer tube into the dipping solution for forming nanostructures for 10 minutes or longer.

As one specific embodiment of the present disclosure, the organic solvent of 1) of the present disclosure may be selected from the group consisting of acetone, ethanol and mixtures thereof.

As one specific embodiment of the present disclosure, the acidic solution of 3) of the present disclosure may be 2 M hydrochloric acid (HCl).

As one specific embodiment of the present disclosure, the heat transfer tube of the present disclosure may be formed with Al-bras.

As one specific embodiment of the present disclosure, the heat transfer tube of the present disclosure may have a form of assembling a plurality of heat transfer tubes.

As one specific embodiment of the present disclosure, 6) forming a hydrophobic coating layer by dipping the heat transfer tube into a silane-based coating solution may be further comprised after 5) of the present disclosure.

As one specific embodiment of the present disclosure, the silane-based coating solution of the present disclosure may comprise a silane-based compound selected from the group consisting of heptadeca-fluoro-1,1,2,2,2-tetrahydrodecyl trichlorosilane (HDFS), trichloro(1H,1H,2H,2H-perfluorooctyl)silane (TFTS), trichloro(octyl)silane (OTS) and dichlorodimethylsilane (DCDMS).

As one specific embodiment of the present disclosure, the silane-based coating solution of the present disclosure may comprise a silane-based compound selected from the group consisting of heptadeca-fluoro-1,1,2,2,2-tetrahydrodecyl trichlorosilane (HDFS), trichloro(1H,1H,2H,2H-perfluorooctyl)silane (TFTS), trichloro(octyl)silane (OTS) and dichlorodimethylsilane (DCDMS), and a volatile solvent.

As one specific embodiment of the present disclosure, the silane-based coating solution of the present disclosure may comprise the silane-based compound in 0.1 parts by weight or greater based on 100 parts by weight of the volatile solvent.

As one specific embodiment of the present disclosure, the present disclosure relates to a heat transfer tube comprising a superhydrophobic surface comprising nanostructures formed on the surface using the above-mentioned manufacturing method.

As one specific embodiment of the present disclosure, the nanostructures of the present disclosure may comprise $Cu_2O$ and CuO.

As one specific embodiment of the present disclosure, the heat transfer tube of the present disclosure may comprise a silane-based compound.

As one specific embodiment of the present disclosure, the heat transfer tube of the present disclosure may have a surface contact angle of 145 degrees or larger.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

A heat transfer tube comprising a superhydrophobic surface of the present disclosure and a method for manufacturing the same will be described with reference to drawings as follows.

Figure 1:
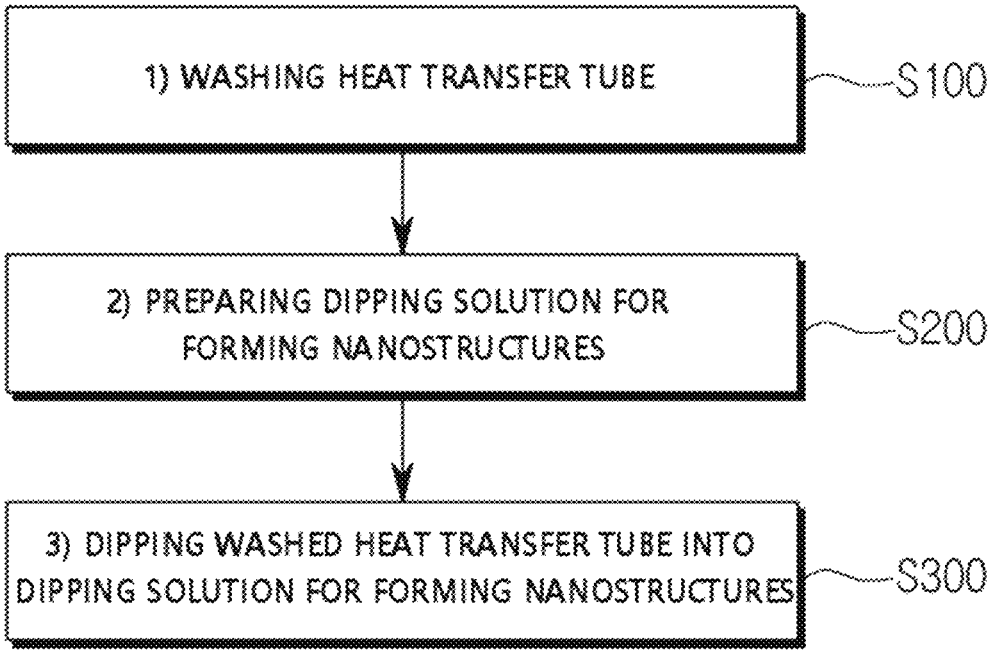
FIG. 1 is a flow chart illustrating a method for manufacturing a heat transfer tube comprising a superhydrophobic surface according to one embodiment of the present disclosure.

FIG. 1 is a flow chart illustrating a method for manufacturing a heat transfer tube comprising a superhydrophobic surface according to one embodiment of the present disclosure. More specifically, the method comprises 1) washing a heat transfer tube (S100); 2) preparing a dipping solution for forming nanostructures (S200); and 3) dipping the washed heat transfer tube into the dipping solution for forming nanostructures (S300).

Figure 12:
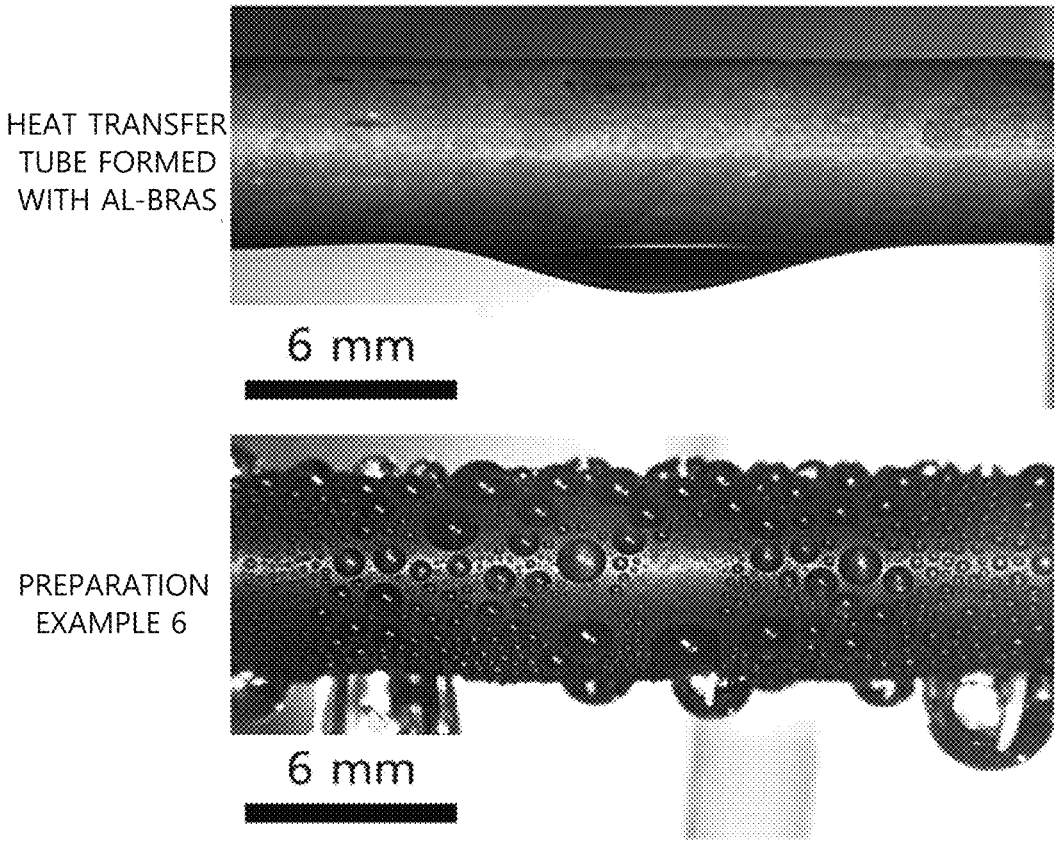
FIG. 12 shows pictures comparing a condensation behavior of a heat transfer tube formed with Al-bras and a condensation behavior of a heat transfer tube formed with Al-bras and comprising a superhydrophobic surface according to one embodiment of the present disclosure.

The heat transfer tube in the present disclosure may be formed with Al-bras, and as the heat transfer tube for forming nanostructures, each heat transfer tube may be individually formed nanostructures, and may be assembled to be used in a condenser. However, in order to simplify a production process, a plurality of heat transfer tubes are assembled in a form to be used in the condenser, and nanostructures may be formed on the surfaces of the assembled heat transfer tubes using the above-mentioned manufacturing method. FIG. 12 shows pictures comparing a condensation behavior of a heat transfer formed with Al-bras and a condensation behavior of a heat transfer tube formed with Al-bras and comprising a superhydrophobic surface according to one embodiment of the present disclosure. The heat transfer tube formed with Al-bras is without a hydrophobic surface, and thus water vapor comprised in the air that is in contact with the heat transfer tube is not readily condensed whereas, in the heat transfer tube according to one embodiment of the present disclosure, condensation on the surface of the heat transfer tube is identified to have the superhydrophobic surface.

In step 1) (S100), a heat transfer tube is washed, and more specifically, the step comprises 1-1) ultrasonicating a heat transfer tube in an organic solvent; 1-2) washing the ultrasonicated heat transfer tube using water, and then removing residual moisture using nitrogen gas; and 1-3) dipping the moisture-removed heat transfer tube into an acidic solution, washing the tube with water, and then removing residual moisture using nitrogen gas.

For step 1-1) of ultrasonicating the heat transfer tube in the organic solvent, the organic solvent may be selected from the group consisting of acetone, ethanol and mixtures thereof. More specifically, the heat transfer tube is placed in acetone and first ultrasonicated for 3 minutes to 7 minutes, and the heat transfer tube completed with the first ultrasonication may be placed in ethanol and second ultrasonicated for 3 minutes to 7 minutes. When ultrasonicating the heat transfer tube, the organic solvent is used as a quenching liquid, and foreign substances and the like adhering to the surface may be removed by placing the heat transfer tube in the quenching liquid and applying ultrasonic vibration to the quenching liquid.

After the ultrasonication, the heat transfer tube is washed using water, and after removing residual moisture using nitrogen gas, the moisture-removed heat transfer tube is dipped into an acidic solution. The heat transfer tube is formed with metals and comprises a naturally occurring metal oxide layer, and in order to remove such an oxide layer naturally formed on the surface of the metal heat transfer tube, the heat transfer tube may be dipped into an acidic solution. The acidic solution may use a 2 M hydrochloric acid (HCl) solution, but, in addition to the hydrochloric acid solution, any solution may be used without any limit as long as it is capable of removing the oxide layer produced on the heat transfer tube surface. However, dipping the heat transfer tube into the acidic solution is for removing the metal oxide layer produced on the surface, and the metal oxide layer may be removed by dipping the tube for a short period of time, such as 20 to 40 seconds. When the tube is dipped for shorter than 20 seconds, the metal oxide may remain without being removed, and when dipped for longer than 40 seconds, metals of the heat transfer tube other than the metal oxide layer may be removed.

Step 2) (S200) comprises preparing a dipping solution for forming nanostructures, and the dipping solution for forming nanostructures comprises water; $NaClO_2$; NaOH; and $Na_3PO_4$. More specifically, the dipping solution may comprise $NaClO_2$ in 1 part by weight to 4 parts by weight; NaOH in 3.5 parts by weight to 10 parts by weight; and $Na_3PO_4$ in 5 parts by weight to 11 parts by weight with respect to 100 parts by weight of water, although the dipping solution is not limited to the example.

$NaClO_2$ of the dipping solution for forming the nanostructures is for providing oxygen atoms, and being comprised of it in less than 1 part by weight or greater than 4 parts by weight may have a problem in that the nanostructures may not be formed on the heat transfer tube.

NaOH is a strong oxidizer and is a main material forming the nanostructures on the heat transfer tube surface, and being comprised of it in less than 4 parts by weight may hinder the formation of the nanostructures.

Figure 3:
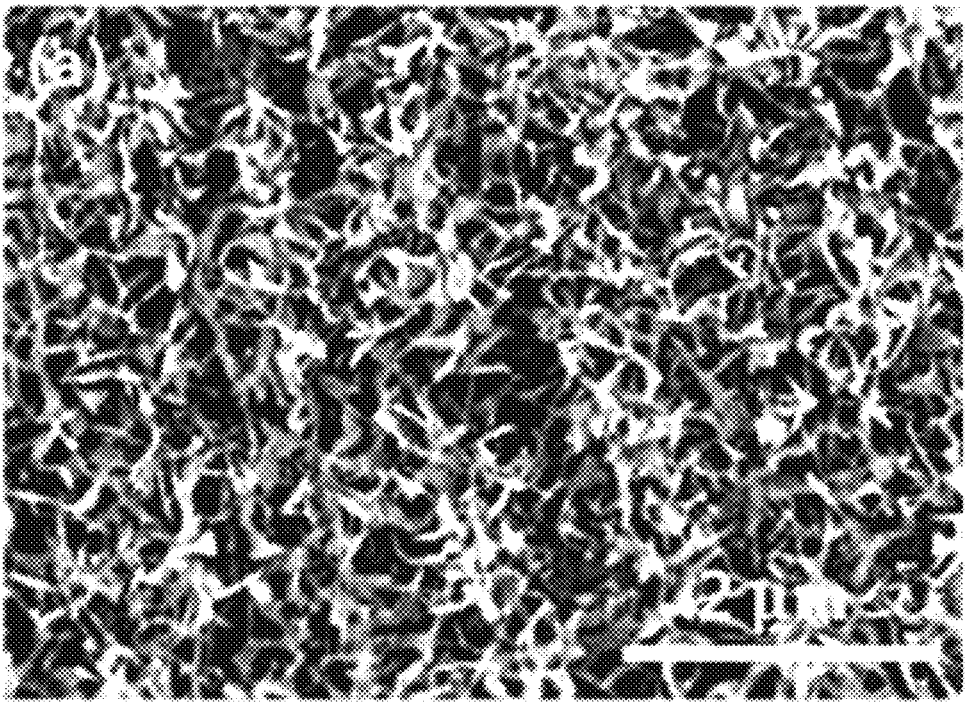
FIG. 3 is a SEM image of a heat transfer tube comprising nanostructures formed on the surface.
Figure 4:
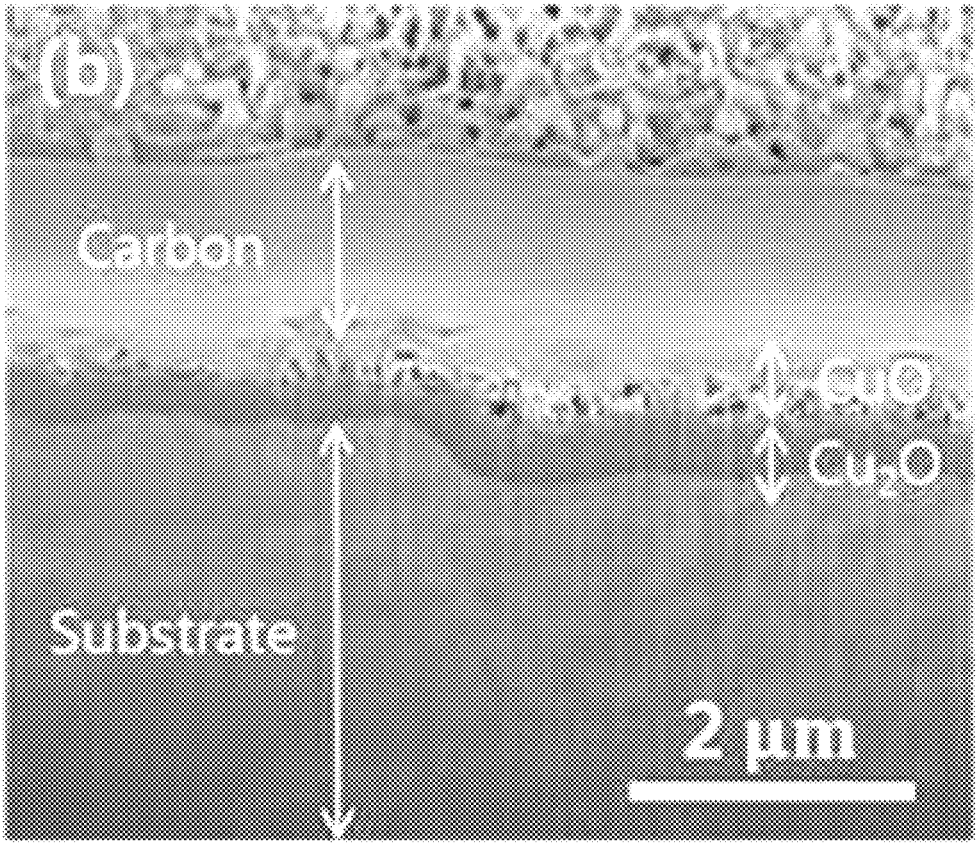
FIG. 4 is a FIB image of a heat transfer tube comprising nanostructures formed on the surface.

$Na_3PO_4$ is a material comprising a CuO layer formed on a $Cu_2O$ layer and facilitating adhesion between the two layers. FIG. 3 is a SEM image of the heat transfer tube comprising nanostructures formed on the surface, FIG. 4 is a FIB image of the heat transfer tube comprising nanostructures formed on the surface. According to FIG. 4, formation of the $Cu_2O$ layer and the CuO layer is identified on the heat transfer tube surface. In other words, nanostructures formed on the surface of the heat transfer tube are the $Cu_2O$ layer and the CuO layer, and $Na_3PO_4$ allows the CuO layer to form on an upper surface of the $Cu_2O$ layer formed adjoining the surface of the heat transfer tube, where $Na_3PO_4$ may facilitate adhesion of the two layers. In addition, when $Na_3PO_4$ is present in less than 5 parts by weight or greater than 11 parts by weight in the dipping solution for forming nanostructures, no nanostructure formation may occur on some parts of the heat transfer tube surface. In other words, there may be a problem of non-uniform nanostructure formation.

Step 3) (S300) comprises dipping the washed heat transfer tube into the dipping solution for forming nanostructures, and the dipping may be for 10 minutes or longer. When the tube is dipped less than 10 minutes, the nanostructure formation found on the heat transfer tube surface may be non-uniform. However, when the tube is dipped for 10 minutes or longer, the nanostructures may be uniformly formed on the heat transfer tube surface.

Figure 2:
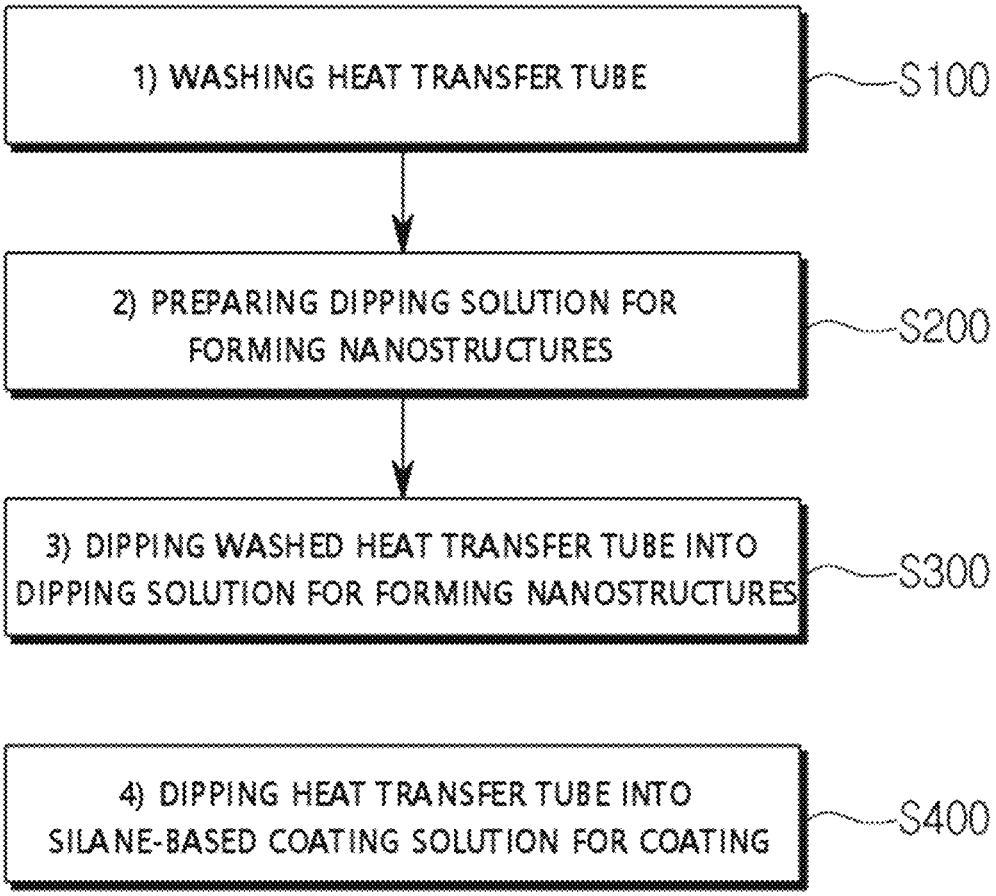
FIG. 2 is a flow chart illustrating a method for manufacturing a heat transfer tube comprising a superhydrophobic surface according to one embodiment of the present disclosure.

FIG. 2 is a flow chart illustrating a method for manufacturing a heat transfer tube comprising a superhydrophobic surface according to one embodiment of the present disclosure. More specifically, the method may comprise 1) washing a heat transfer tube (S100); 2) preparing a dipping solution for forming nanostructures (S200); 3) dipping the washed heat transfer tube into the dipping solution for forming nanostructures (S300); and 4) dipping the heat transfer tube into a silane-based coating solution for coating (S400).

As in FIG. 1, nanostructures are formed on a surface of the heat transfer tube, and in step 4) (S400), a hydrophobic coating layer may be further comprised on an upper surface of the nanostructures formed on the surface of the heat transfer tube. In other words, a hydrophobic coating layer may be formed by dipping the nanostructure-formed heat transfer tube into the silane-based coating solution. By exhibiting superhydrophobicity, the hydrophobic coating layer may enhance hydrophobicity of the nanostructure-formed heat transfer tube.

In step 4) (S400), the coating layer may be formed by dipping the heat transfer tube comprising nanostructures formed on the surface into the silane-based coating solution. The silane-based coating solution may comprise a silane-based compound selected from the group consisting of heptadeca-fluoro-1,1,2,2,2-tetrahydrodecyl trichlorosilane (HDFS), trichloro(1H, 1H,2H,2H-perfluorooctyl)silane (TFTS), trichloro(octyl)silane (OTS) and dichlorodimethylsilane (DCDMS). The coating solution formed only with the silane-based compound may be used, but, a coating solution prepared by mixing a volatile solvent to the silane-based compound may be used as well. When mixing the silane-based compound to the volatile solvent, the silane-based compound in 0.1 part by weight or greater is mixed with 100 parts by weight of the volatile solvent. If the silane-based compound in less than 0.1 part by weight, the hydrophobic coating layer may not be uniformly coated on the heat transfer tube surface, but when the silane-based compound of 0.1 part by weight or greater is present, a uniform hydrophobic coating layer may be formed on the heat transfer tube surface. In one example, the volatile solvent is hexane ($C_6H_{14}$), but, any volatile solvents known to those skilled in the art may be used without being limited to the example.

Hereinafter, the present disclosure will be described in more detail with reference to examples. These examples are only for more practically describing the present disclosure, and it will be obvious to those skilled in the art that the scope of the present disclosure is not limited to these examples by the gist of the present disclosure.

Preparation Example 1

Manufacture of Heat Transfer Tube Comprising Nanostructures Formed on Surface (1) Washing A prepared heat transfer tube is placed in acetone ($CH_3COCH_3$) and ultrasonicated for 3 minutes to 7 minutes, and after that, placed in ethanol ($C_2H_5OH$) and ultrasonicated for 3 minutes to 7 minutes. After the ultrasonication, the tube is washed with DI water, and moisture remaining on the surface is removed using nitrogen gas. In order to remove a metal oxide, the tube is dipped into a 2 M hydrochloric acid (HCl) solution for 20 seconds to 40 seconds. After dipped into the hydrochloric acid, the tube is washed using DI water, and moisture remaining on the surface is removed using nitrogen gas.

(2) Formation of Nanostructures

For nanostructure formation, a dipping solution for forming nanostructures is prepared by mixing $NaClO_2$ in 3.75 parts by weight, NaOH in 5 parts by weight and $Na_3PO_4$ in 10 parts by weight with 100 parts by weight of DI water, and the dipping solution for forming nanostructures is boiled. After dipping the washed heat transfer tube into the boiled dipping solution for forming nanostructures, the tube is washed using DI water, and moisture remaining on the surface is removed using nitrogen gas.

Preparation Example 2

Preparation is carried out in the same manner as in Preparation Example 1 except that $NaClO_2$ of the dipping solution for forming nanostructures is introduced in 1.5 parts by weight.

Preparation Example 3

Preparation is carried out in the same manner as in Preparation Example 1 except that NaOH of the dipping solution for forming nanostructures is introduced in 4 parts by weight.

Preparation Example 4

Preparation is carried out in the same manner as in Preparation Example 1 except that $Na_3PO_4$ of the dipping solution for forming nanostructures is introduced in 6 parts by weight.

Preparation Example 5

Preparation is carried out in the same manner as in Preparation Example 1 except that the heat transfer tube is dipped into the dipping solution for forming nanostructures for 20 minutes.

Preparation Example 6

Manufacture of Heat Transfer Tube Comprising Hydrophobic Coating Layer Formed

For hydrophobic coating, 0.1 part by weight of heptadeca-fluoro-1,1,2,2,2-tetrahydrodecyl trichlorosilane (HDFS) based on 100 mL of a hexane ($C_6H_{14}$) solution is mixed to prepare a hydrophobic coating solution.

The nanostructure-formed heat transfer tube of Preparation Example 1 is dipped into the hydrophobic coating solution for 90 seconds, and washed using DI water, and moisture remaining on the surface is removed using nitrogen gas. After that, the tube is dried in a 50° C. oven for the preparation.

Preparation Example 7

Preparation is carried out in the same manner as in Preparation Example 6 except that a hydrophobic coating solution of 100% by weight of heptadeca-fluoro-1,1,2,2,2-tetrahydrodecyl trichlorosilane (HDFS) is used.

Preparation Example 8

Preparation is carried out in the same manner as in Preparation Example 6 except that the heat transfer tube is dipped into the hydrophobic coating solution for 120 seconds.

Comparative Example 1

Preparation is carried out in the same manner as in Preparation Example 1 except that $NaClO_2$ of the dipping solution for forming nanostructures is introduced in 0.75 part by weight.

Comparative Example 2

Preparation is carried out in the same manner as in Preparation Example 1 except that $NaClO_2$ of the dipping solution for forming nanostructures is introduced in 4.5 parts by weight.

Comparative Example 3

Preparation is carried out in the same manner as in Preparation Example 1 except that NaOH of the dipping solution for forming nanostructures is introduced in 3 parts by weight.

Comparative Example 4

Preparation is carried out in the same manner as in Preparation Example 1 except that $Na_3PO_4$ of the dipping solution for forming nanostructures is introduced in 4 parts by weight.

Comparative Example 5

Preparation is carried out in the same manner as in Preparation Example 1 except that $Na_3PO_4$ of the dipping solution for forming nanostructures is introduced in 12 parts by weight.

Comparative Example 6

Preparation is carried out in the same manner as in Preparation Example 1 except that the heat transfer tube is dipped into the dipping solution for forming nanostructures for 5 minutes.

Comparative Example 7

Preparation is carried out in the same manner as in Preparation Example 6 except that HDFS is introduced in 0.05 part by weight with respect to 100 parts by weight of hexane as the hydrophobic coating solution.

Comparative Example 8

Preparation is carried out in the same manner as in Preparation Example 6 except that the heat transfer tube is dipped into the hydrophobic coating solution for just 60 seconds.

Example 1

Result of Component Analysis on Heat Transfer Tube Comprising Nanostructures Formed on Surface Component analyses are carried out for the nanostructures formed on the surface of the heat transfer tube manufactured as in Preparation Example 1.

TABLE 1

| Element | Weight % | Atomic % |
|---|---|---|
| C | 3.18 | 9.61 |
| O | 20.15 | 45.75 |
| Al | 1.14 | 1.53 |
| Cu | 71.86 | 41.07 |
| Zn | 3.68 | 2.04 |
| Total | 100 | |

As a result of the component analyses, it is identified that the nanostructures are formed with CuO and $Cu_2O$ and thereby comprise Cu and O the most. As for other constituents, Al, Zn and Cu are components forming Al-bras. However, C corresponds to impurities due to contamination naturally occurring during an EDS measuring process after producing the nanostructures on the surface of the heat transfer tube.

Example 2

Comparison of Nanostructures Formed on Surface of Heat Transfer Tube Based on $NaClO_2$ Content in Dipping Solution for Forming Nanostructures SEM images of the surface of the heat transfer tube preparing nanostructures by Preparation Example 1, Preparation Example 2, Comparative Example 1 and Comparative Example 2 are taken, and the degree of uniformity of the nanostructures formed on the surface of the heat transfer tube is observed.

Figure 5:
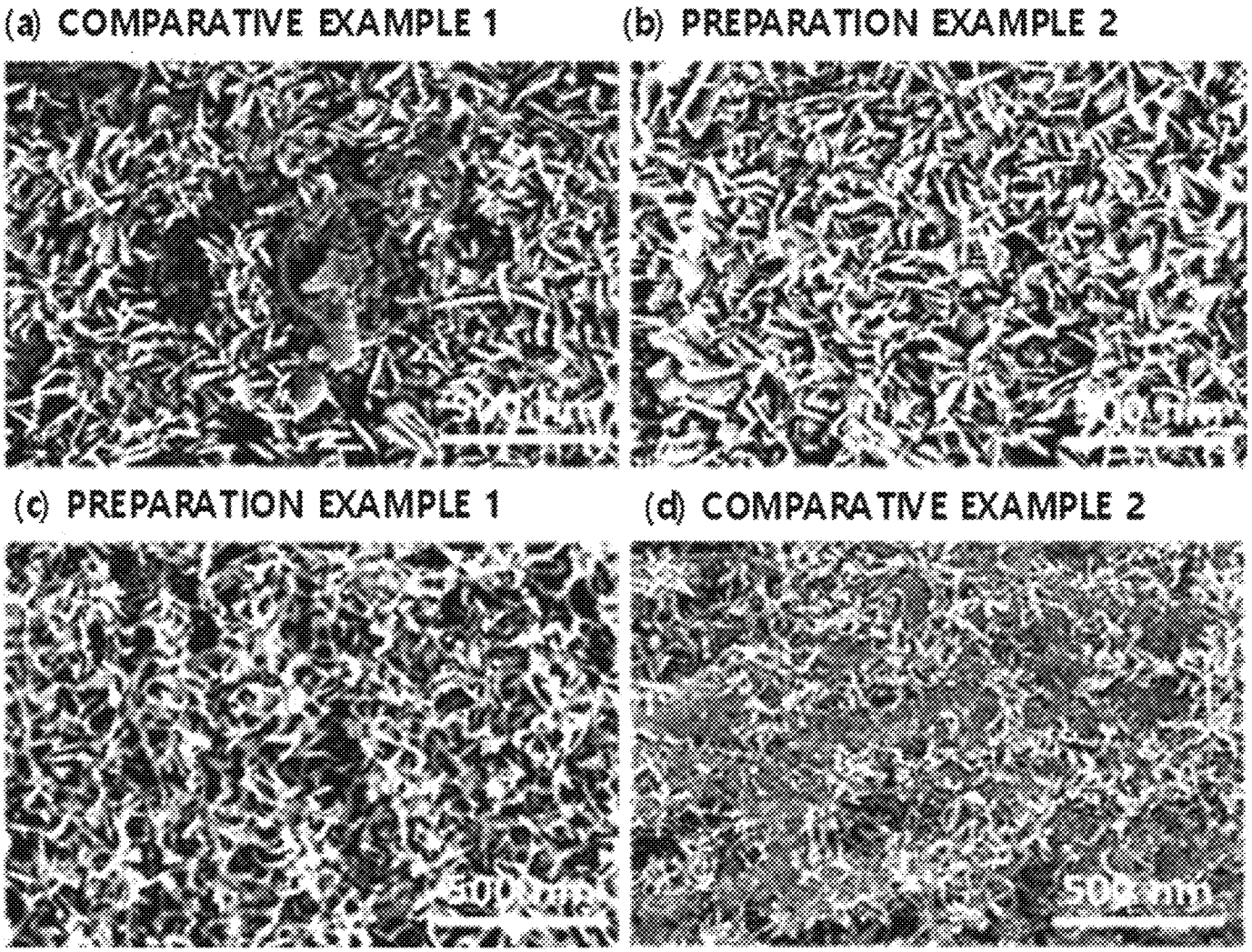
FIG. 5 shows SEM images illustrating the formation of nanostructures on the heat transfer tube surface based on a $NaClO_2$ content in a dipping solution for forming nanostructures.

FIG. 5 shows SEM images for the heat transfer tubes of Preparation Example 1, Preparation Example 2, Comparative Example 1 and Comparative Example 2. In Comparative Examples 1 and 2 of the figure, parts comprising no nanostructure formation are partly found, but nanostructures are uniformly formed in Preparation Examples 1 and 2 of the figure.

As a result, when the $NaClO_2$ content range in the dipping solution for forming nanostructures is less than or greater than the range according to one embodiment of the present disclosure, the nanostructures are not uniformly formed on the surface of the heat transfer tube, thus causing a problem of reduced hydrophobicity. Meanwhile, in Preparation Examples 1 and 2 comprising the $NaClO_2$ range in the range of the present disclosure, uniform nanostructure formation is identified, and the heat transfer tube comprising a superhydrophobic surface is identified.

Example 3

Comparison of Nanostructures Formed on Surface of Heat Transfer Tube Depending on NaOH Content in Dipping Solution for Forming Nanostructures SEM images of the surface of the heat transfer tube preparing nanostructures by Preparation Example 1, Preparation Example 3 and Comparative Example 3 are taken, and the degree of uniformity of the nanostructures formed on the surface of the heat transfer tube is observed.

Figure 6:
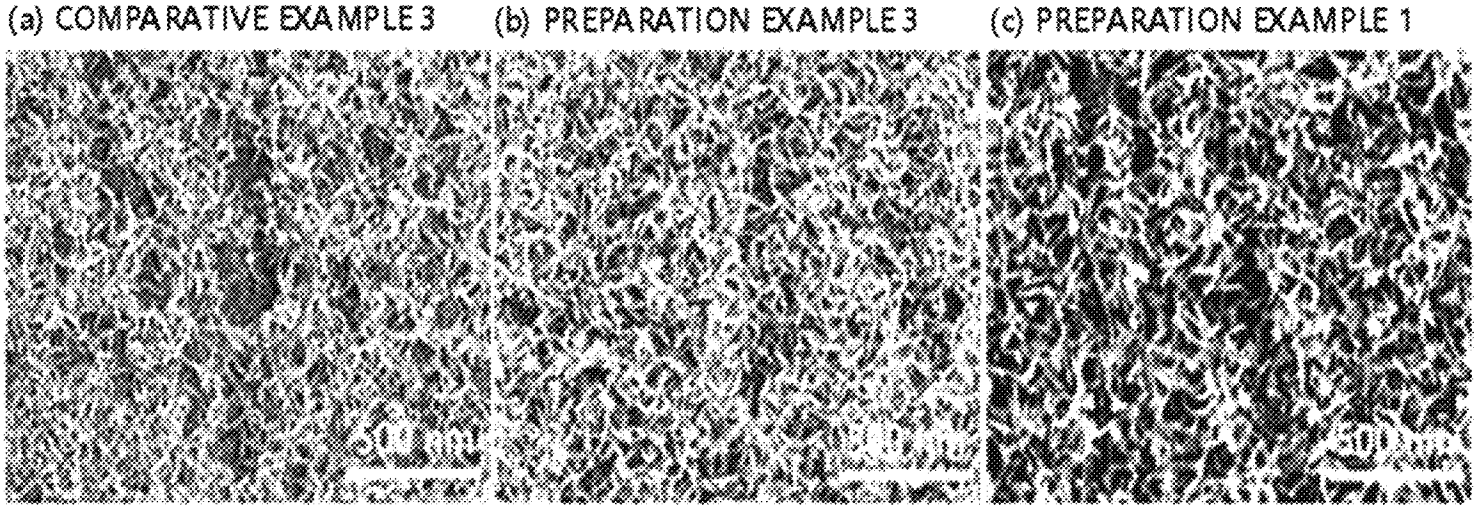
FIG. 6 shows SEM images illustrating the formation of nanostructures on the heat transfer tube surface based on a NaOH content in a dipping solution for forming nanostructures.

FIG. 6 shows SEM images for the heat transfer tubes of Preparation Example 1, Preparation Example 3 and Comparative Example 3. In Comparative Example 3, parts comprising no nanostructure formation are partly found, but nanostructures are uniformly formed in Preparation Examples 1 and 3.

As a result, when the NaOH content range in the dipping solution for forming nanostructures is less than the range according to one embodiment of the present disclosure, nanostructures are not uniformly formed on the surface of the heat transfer tube, thereby causing a problem of reduced hydrophobicity. Meanwhile, in Preparation Examples 1 and 3 comprising the NaOH range in the range of the present disclosure, uniform nanostructure formation is identified, and the heat transfer tube comprising a superhydrophobic surface is identified.

Example 4

Comparison of Nanostructures Formed on Surface of Heat Transfer Tube Depending on $Na_3PO_4$ Content in Dipping Solution for Forming Nanostructures SEM images of the surface of the heat transfer tube preparing nanostructures by Preparation Example 1, Preparation Example 4, Comparative Example 4 and Comparative Example 5 are taken, and the degree of uniformity of the nanostructures formed on the surface of the heat transfer tube is observed.

Figure 7:
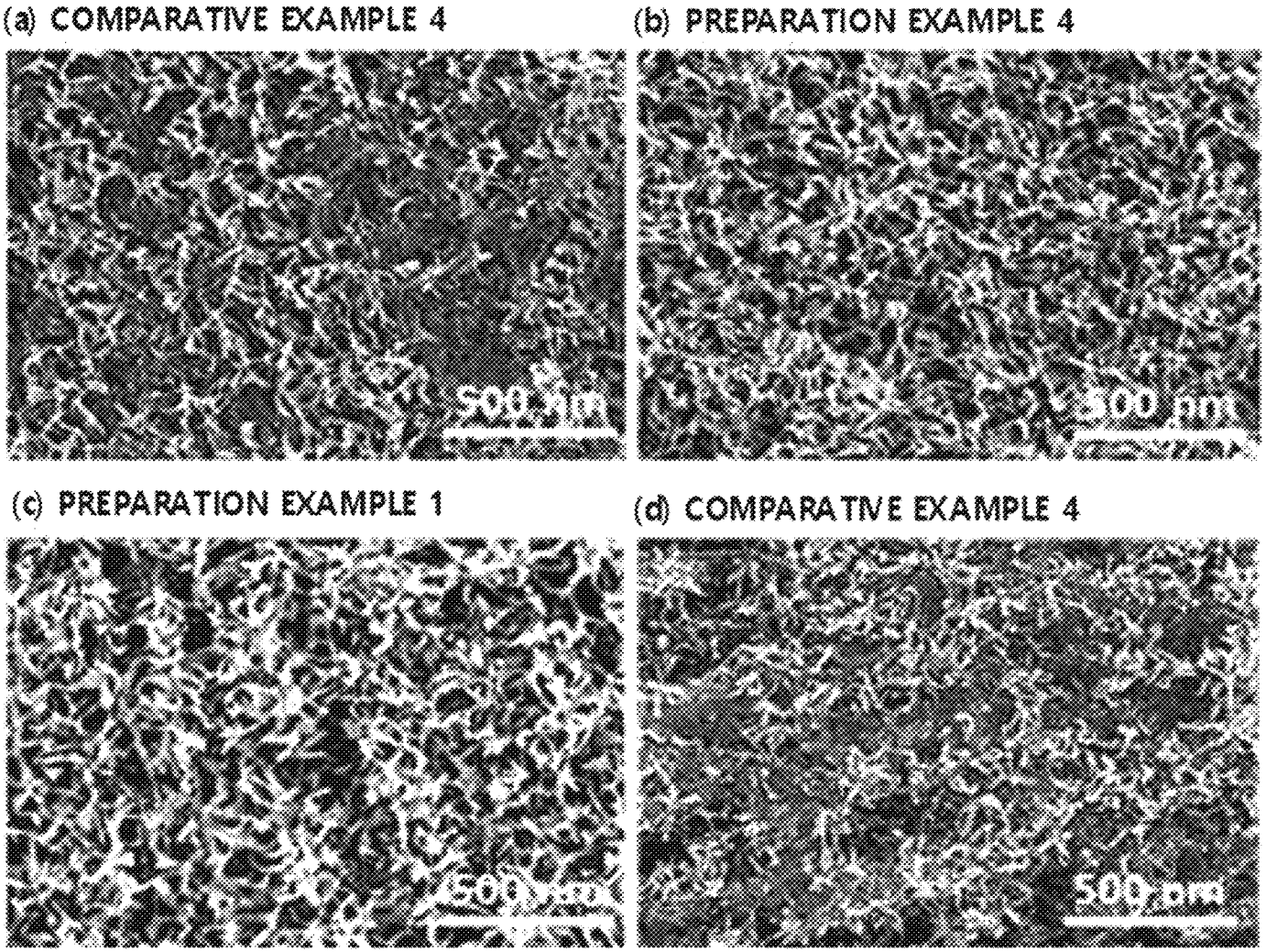
FIG. 7 shows SEM images illustrating the formation of nanostructures on the heat transfer tube surface based on a $Na_3PO_4$ content in a dipping solution for forming nanostructures.

FIG. 7 shows SEM images for the heat transfer tubes of Preparation Example 1, Preparation Example 4, Comparative Example 4 and Comparative Example 5. In Comparative Examples 4 and 5, parts comprising no nanostructure formation are partly found, but the nanostructures are uniformly formed in Preparation Examples 1 and 4.

As a result, when the $Na_3PO_4$ content range in the dipping solution for forming nanostructures is less than or greater than the range according to one embodiment of the present disclosure, the nanostructures are not uniformly formed on the surface of the heat transfer tube, thus causing a problem of reduced hydrophobicity. Meanwhile, in Preparation Examples 1 and 4 comprising the $Na_3PO_4$ range in the range of the present disclosure, uniform nanostructure formation is identified, and the heat transfer tube comprising a superhydrophobic surface is identified.

Example 5

Comparison of Nanostructures Formed Depending on Time of Dipping Heat Transfer Tube into Dipping Solution for Forming Nanostructures SEM images for the heat transfer tubes prepared while varying the time of dipping the heat transfer tube into the dipping solution for forming nanostructures as in Preparation Example 1, Preparation Example 5 and Comparative Example 6 are taken, and the degree of uniformity of the nanostructures formed on the surface of the heat transfer tube is observed.

Figure 8:
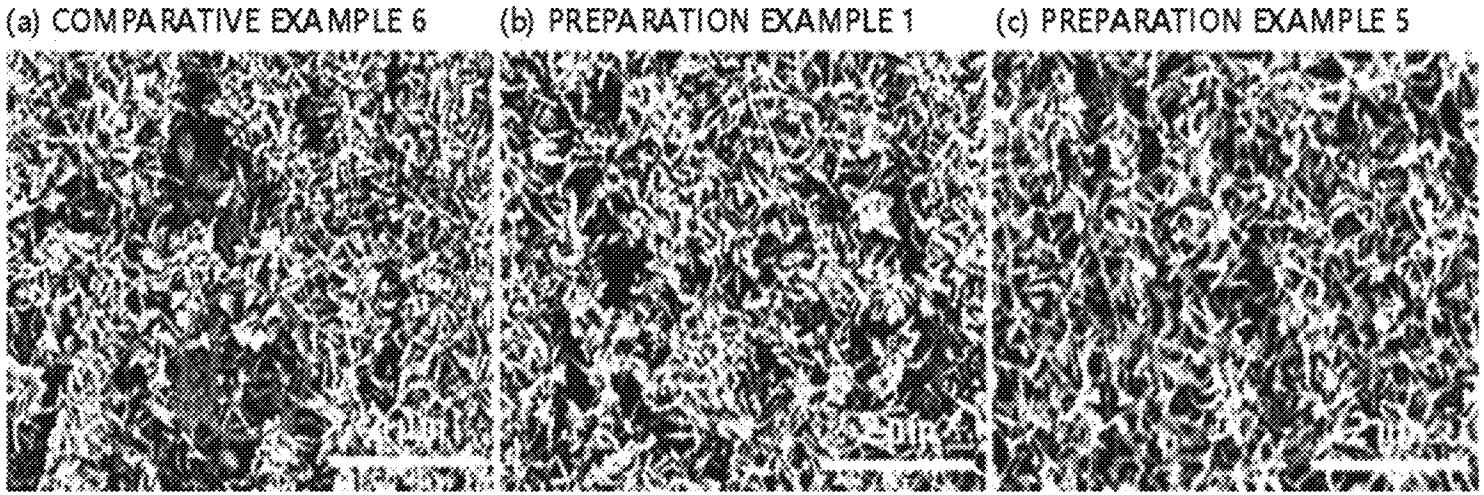
FIG. 8 shows SEM images illustrating the formation of nanostructures on the heat transfer tube surface based on a time of dipping into a dipping solution for forming nanostructures.

FIG. 8 shows SEM images for the heat transfer tubes of Preparation Example 1, Preparation Example 5 and Comparative Example 6. In Comparative Example 6, which illustrates dipping into the dipping solution for forming nanostructures for approximately 5 minutes, parts comprising no nanostructure formation are found, but the nanostructures are uniformly formed in Preparation Examples 1 and 5, which illustrate dipping into the dipping solution for 10 minutes or longer.

As a result, when dipping the heat transfer tube into the dipping solution for forming nanostructures according to one embodiment of the present disclosure, the nanostructures are not uniformly formed on the surface of the heat transfer tube when dipping for shorter than 10 minutes, thus causing a problem of reduced hydrophobicity. Meanwhile, in Preparation Examples 1 and 5, which have a dipping time of 10 minutes or longer, uniform nanostructure formation is identified, and the heat transfer tube comprising a superhydrophobic surface is identified.

Example 6

Comparison of Contact Angle Results Depending on Silane-Based Compound Content in Hydrophobic Coating Solution A hydrophobic coating solution is prepared while varying a silane-based compound content in the hydrophobic coating solution as in Preparation Example 6, Preparation Example 7 and Comparative Example 5, and after forming a hydrophobic coating layer by dipping the nanostructure-formed heat transfer tube thereinto, a contact angle is measured.

Figure 9:
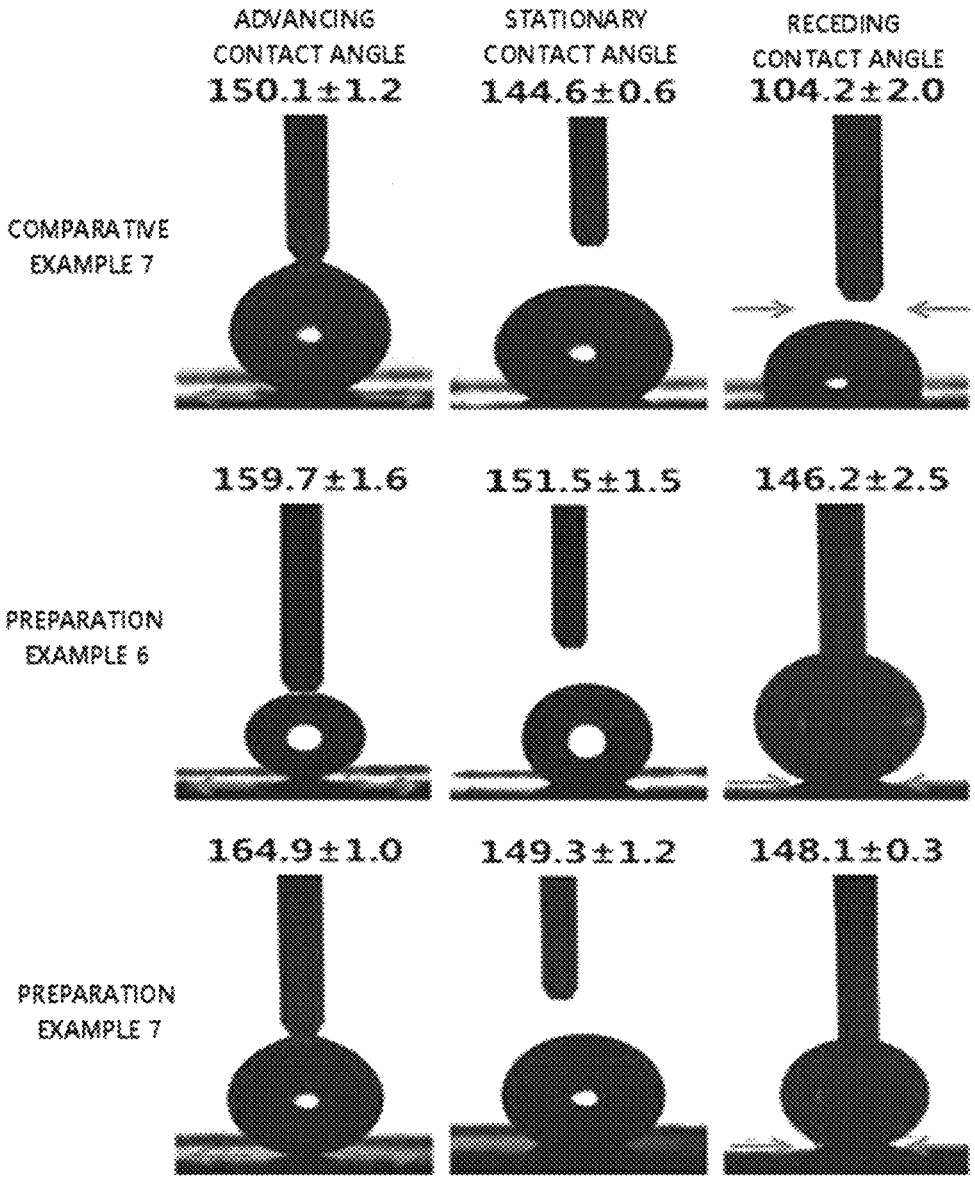
FIG. 9 shows contact angle images of a hydrophobic coating layer based on a silane-based compound content.

FIG. 9 measures an advancing contact angle, a stationary contact angle and a receding contact angle for Preparation Example 6, Preparation Example 7 and Comparative Example 7. In Comparative Example 5, which comprises a silane-based compound in 0.05 part by weight in the hydrophobic coating solution, a receding contact angle is measured as approximately 104 degrees Celsius, which means that the coating layer is non-uniformly formed, and in Preparation Examples 6 and 7, superhydrophobicity is obtained in light of the fact that all the contact angles appeared to be 145 degrees or larger.

Example 7

Comparison of Contact Angle Results Depending on Dipping Time when Dipping Heat Transfer Tube into Hydrophobic Coating Solution A hydrophobic coating layer is formed while varying a time of dipping the heat transfer tube into the hydrophobic coating solution as in Preparation Example 6, Preparation Example 8 and Comparative Example 8, and a contact angle is measured.

Figure 10:
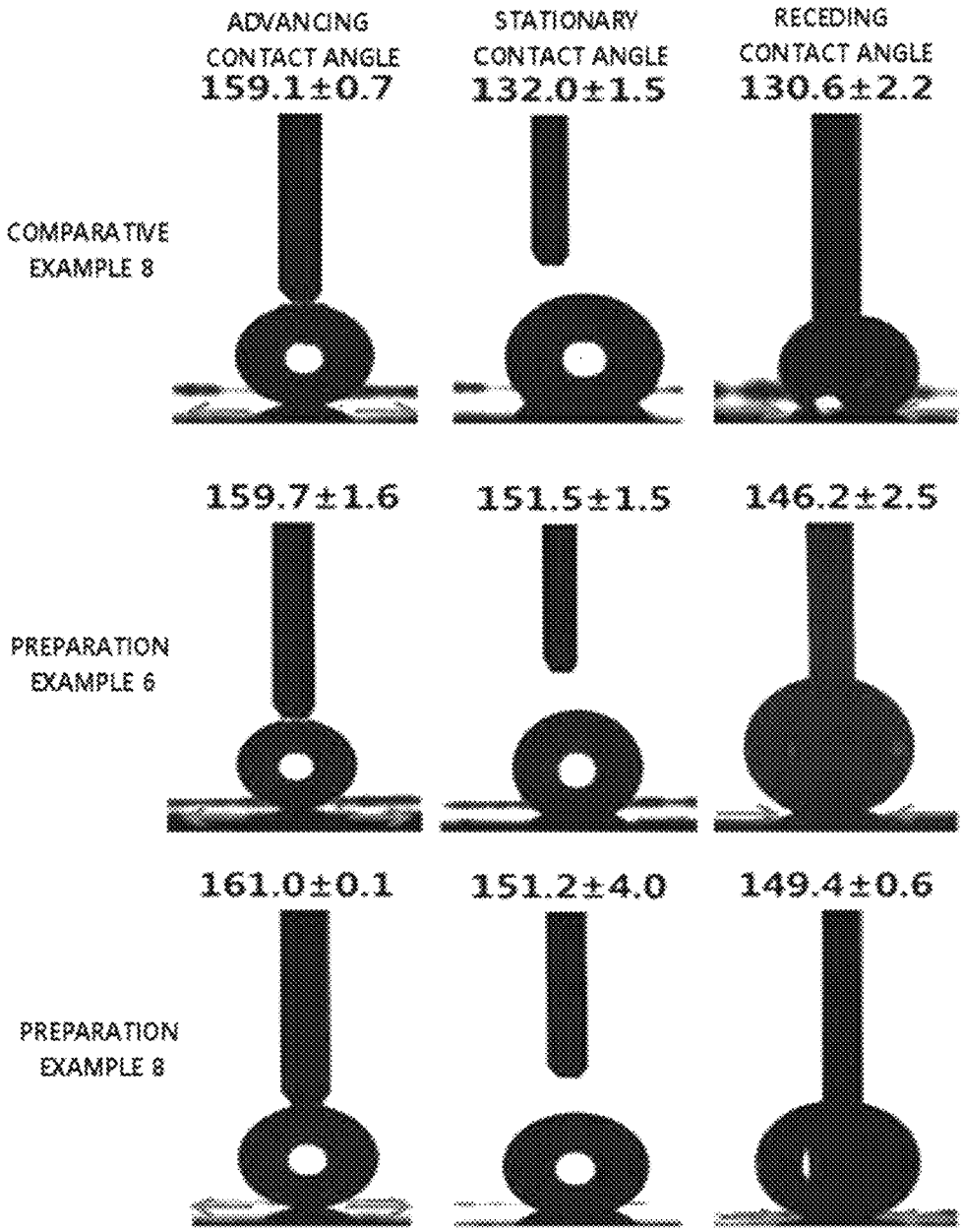
FIG. 10 shows contact angle images of the hydrophobic coating layer based on a dipping time for forming the hydrophobic coating layer.

FIG. 10 shows results of measuring contact angles of the heat transfer tubes comprising a hydrophobic coating layer formed by Preparation Example 6, Preparation Example 8 and Comparative Example 8. When dipping the heat transfer tube into the hydrophobic coating solution for just 60 seconds as in Comparative Example 8, a stationary contact angle and a receding contact angle are measured as approximately 130 degrees, which means that the hydrophobic coating layer is non-uniformly formed, and the hydrophobic coating layer being non-uniformly formed as in Comparative Example 6 has a problem of reducing hydrophobicity.

Meanwhile, when dipping the heat transfer tube into the hydrophobic coating solution for 90 seconds or longer to form a hydrophobic coating layer as in Preparation Examples 6 and 8, the hydrophobic coating layer is uniformly formed with all the contact angles being 145 degrees or larger, and the heat transfer tube surface exhibiting superhydrophobicity.

Example 8

Measurement of Condensation Heat Transfer of Heat Transfer Tube Comprising Superhydrophobic Surface Condensation heat transfer experiments are carried out for the heat transfer tube comprising nanostructures and a hydrophobic coating layer formed on the surface by Preparation Example 6 as well as for a heat transfer tube formed with Al-bras without the surface modification.

Figure 11:
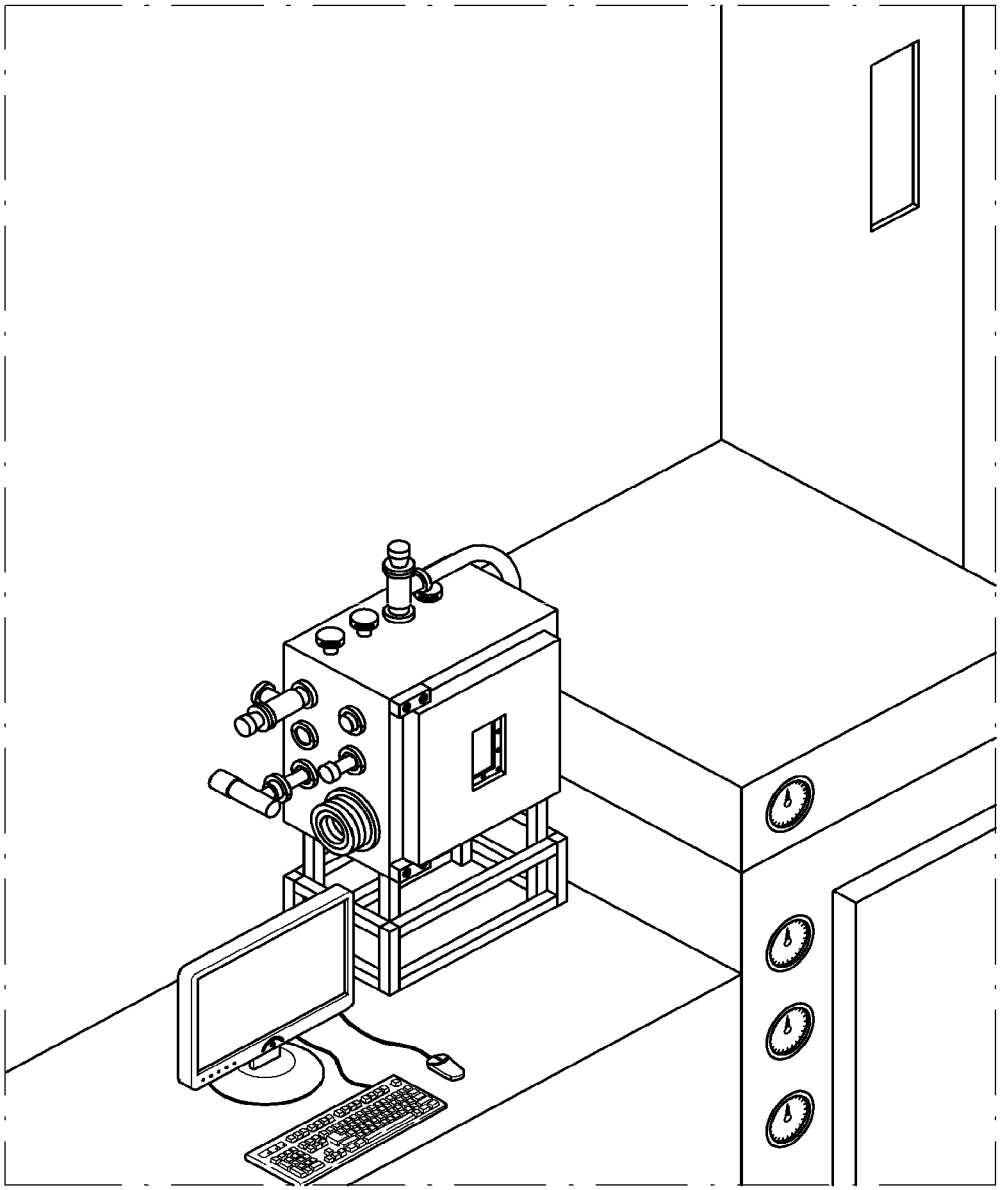
FIG. 11 shows a picture of condensation heat transfer test equipment.

The condensation heat transfer test is measured using condensation heat transfer test equipment as in FIG. 11. A square vacuum chamber made of stainless steel is present, and a heat transfer tube is connected internally. In order to measure an accurate condensation heat transfer coefficient, non-condensable gas inhibiting condensation needs to be removed, and inside the chamber is conditioned to be 0.5 Pa or less using a vacuum pump. The corresponding degree of vacuum is identified through a pressure sensor connected to the left side of the vacuum chamber. Using a separate stainless circular container connected to the right side of the vacuum chamber, hot steam is supplied into the vacuum chamber in which an environment of 0.5 Pa or less of the degree of vacuum is created. Clean water is introduced to the corresponding stainless circular container, and steam as above is supplied by boiling the water to 100 degrees using a heater. After that, when a steam environment under which inside the vacuum chamber is hot is created, cold water (25 degrees) set using a thermal bath connected to the right side of the vacuum chamber is supplied to the heat transfer tube connected inside the vacuum chamber. The corresponding heat transfer tube is covered by a thermal insulation material to prevent unnecessary condensation at the heat transfer tube connecting site, and thermocouple probes are connected to the inlet/outlet parts of the heat transfer tube to measure changes in the temperature when the water supplied from the thermal bath passed through the heat transfer tube. A condensation behavior at the outer wall of the heat transfer tube is observed using a CCD camera located on the left side of the vacuum chamber, and the temperature values measured from the thermocouple probes are received using a computer to finally measure a condensation heat transfer coefficient.

A condensation heat transfer coefficient is calculated as follows. First, temperatures of the heat transfer tube inlet/outlet are measured using thermocouple probes, and a total energy amount supplied to the heat transfer tube is calculated using these values.

$$Q=\dot{m}C_p(T_{out}-T_{in})$$

Herein, Q means a total heat transfer amount, $\dot{m}$ means a flow rate of water flowing inside the heat transfer tube, $C_p$ means specific heat under constant pressure of water, $T_{end}$ means a temperature of water on the outlet side of the heat transfer tube, and $T_{in}$ means a temperature of water on the inlet side of the heat transfer tube.

Using the calculated total heat transfer amount, an overall heat transfer coefficient value is calculated.

$$\dot{m}C_p(T_{out}-T_{in})=UA\Delta T_{LMTD}$$

Herein, U means an overall heat transfer coefficient value, A means a total area of the heat transfer tube, and $T_{LMTD}$ means a logarithmic mean temperature difference. $T_{LMTD}$ is calculated as follows.

$$T_{LMTD}=\frac{(T_v-T_{in})-(T_v-T_{out})}{\ln\left(\frac{T_v-T_{in}}{T_v-T_{out}}\right)}$$

The overall heat transfer coefficient calculated as above is different from a condensation heat transfer coefficient. The overall heat transfer coefficient is a heat transfer coefficient value between water flowing inside the heat transfer tube and external steam. When subtracting a forced convection heat transfer coefficient value by water flowing inside the heat transfer tube and an influence of temperature drop caused by the heat transfer tube thickness from this value, a condensation heat transfer coefficient may be obtained. Accordingly, the condensation heat transfer coefficient is calculated as follows.

$$h_e=\left(\frac{1}{U}-\frac{A}{A_ih_i}-\frac{A\ln(d_{OD}/d_{ID})}{2\pi Lk_{Al\text{-}brass}}\right)^{-1}$$

Herein, $h_e$ means a condensation heat transfer coefficient, $A_i$ means an inside area of the heat transfer tube, $h_i$ means a forced convection heat transfer coefficient obtained by a flow of water inside the heat transfer tube, $d_{OD}$ means an outer diameter of the heat transfer tube, $d_{ID}$ means an inner diameter of the heat transfer tube, L means a length of the heat transfer tube, and $K_{Al\text{-}brass}$ means a heat transfer coefficient of the Al-bras heat transfer tube. $h_i$ is calculated as follows.

$$h_i=\frac{k_i}{d_{ID}}\frac{(f/8)(Re-1000)Pr}{1+12.7(f/8)^{1/2}(Pr^{2/4}-1)}$$

Herein, f is a friction coefficient of the tube, Re is a Reynolds number of water flowing inside the heat transfer tube, and Pr is a Prandtl number.

TABLE 2

| | Preparation Example 6 | Pure Al-bras |
|---|---|---|
| Mean Condensation Heat Transfer Coefficient Value ($h_e$) | 59.6 | 14.4 |
| Standard Deviation | 1.4 | 0.7 |

As a result of the condensation heat transfer test, it is identified that the heat transfer tube comprising nanostructures and a hydrophobic coating layer formed on the surface by Preparation Example 6 has an improvement in the condensation heat transfer performance by approximately 4.1 times compared to the heat transfer tube formed with Al-bras without surface modification.

As shown in FIG. 12, liquid film-type condensation takes place on the Al-bras surface without surface modification, whereas liquid drops are readily removed from the surface as water drop condensation occurs on the Al-bras surface comprising nanostructures and hydrophobic coating formed on the surface as in Preparation Example 6 of the present disclosure. Such a water drop condensation behavior is more superior in the condensation heat transfer performance compared to a film condensation behavior.

Figure 13:
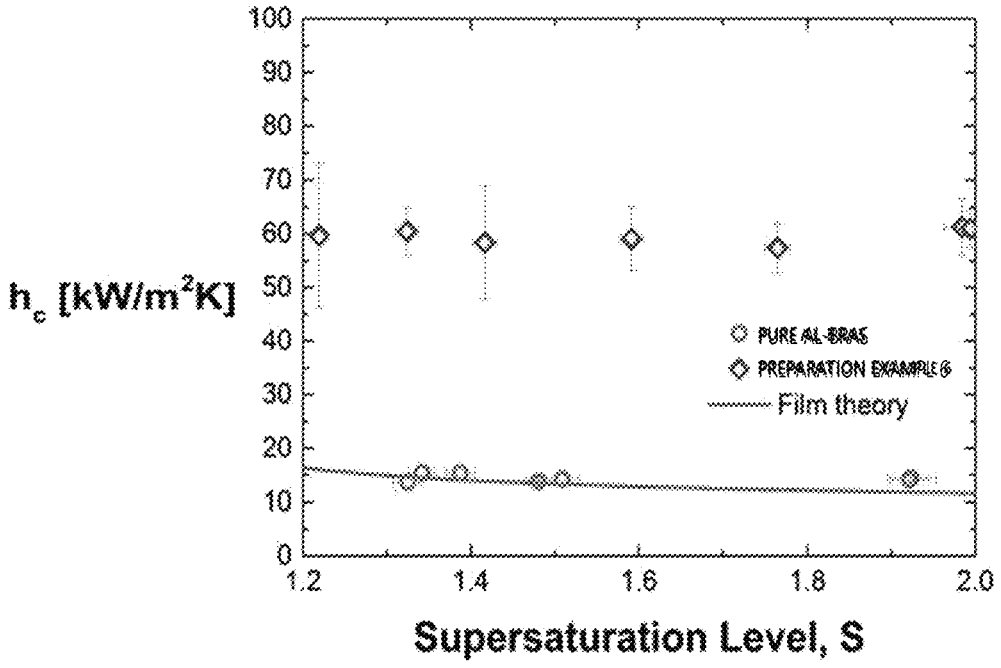
FIG. 13 shows results of measuring a heat transfer coefficient (supersaturation level, S) of the heat transfer tube formed with Al-bras without surface modification and the heat transfer tube manufactured as in Preparation Example 1 at various condensation levels.

FIG. 13 shows results of measuring a heat transfer coefficient (supersaturation level, S), which means condensation heat transfer performance, of the Al-bras surface without surface modification and the Al-bras surface of Preparation Example 6 at various condensation levels, and it is identified that the Al-bras of Preparation Example 6 has a larger condensation heat transfer coefficient ($h_e$) by approximately 3 times. This means that condensation heat transfer performance of the heat transfer tube comprising a superhydrophobic surface according to one embodiment of the present disclosure is far superior compared to the heat transfer tube formed with pure Al-bras without the surface modification.

The present disclosure relates to a heat transfer tube comprising nanostructures formed on the surface, and a method for manufacturing the same, and by forming the nanostructures on a heat transfer tube surface, a superhydrophobic surface can be obtained under a high temperature environment as well. In addition, superhydrophobicity may be enhanced by further forming a hydrophobic coating layer on the nanostructure-formed heat transfer tube surface. By using the method of forming nanostructures by dipping the heat transfer tube surface, complex shapes can be coated, and therefore, a plurality of assembled heat transfer tubes can be coated, and damages occurring during the process of assembling the heat transfer tubes after the coating of the tubes may be prevented.

What is claimed is:

1. A method for manufacturing a heat transfer tube comprising a superhydrophobic surface, the method comprising:

ultrasonicating a heat transfer tube using an organic solvent;

washing the ultrasonicated heat transfer tube;

removing a metal oxide on a surface of the heat transfer tube by dipping the washed heat transfer tube into an acidic solution;

preparing a dipping solution for forming nanostructures; and dipping the heat transfer tube from which the metal oxide on the surface has been removed into the dipping solution for forming nanostructures, wherein the ultrasonicating comprises first ultrasonicating the heat transfer tube in acetone for 3 to 7 minutes and second ultrasonicating the first ultrasonicated heat transfer tube in ethanol for 3 to 7 minutes, and wherein the heat transfer tube is formed of a plurality of assembled heat transfer tubes, and the dipping comprises dipping the plurality of assembled heat transfer tubes into the dipping solution for forming nanostructures.

2. The method of claim 1, wherein the washing the ultrasonicated heat transfer tube comprises washing the ultrasonicated heat transfer tube with water, and removing residual moisture using nitrogen gas.

3. The method of claim 1, wherein the acidic solution is 2 M hydrochloric acid (HCl).

4. The method of claim 1, wherein the dipping solution for forming nanostructures comprises water, $NaClO_2$, NaOH and $Na_3PO_4$.

5. The method of claim 4, wherein the dipping solution for forming nanostructures comprises the $NaClO_2$ in 1 part by weight to 4 parts by weight; the NaOH in 3.5 parts by weight to 10 parts by weight; and the $Na_3PO_4$ in 5 parts by weight to 11 parts by weight with respect to 100 parts by weight of the water.

6. The method of claim 1, wherein the dipping comprises dipping the heat transfer tube into the dipping solution for forming nanostructures for 10 minutes or longer.

7. The method of claim 1, wherein the nanostructures comprise $Cu_2O$ and CuO.

8. The method of claim 1, wherein the heat transfer tube is formed with aluminum.

9. The method of claim 1, further comprising forming a hydrophobic coating layer by dipping the heat transfer tube into a silane-based coating solution.

10. The method of claim 1, wherein the silane-based coating solution comprises a silane-based compound selected from the group consisting of heptadeca-fluoro-1,1,2,2,2-tetrahydrodecyl trichlorosilane (HDFS), trichloro (1H,1H,2H,2H-perfluorooctyl) silane (TFTS), trichloro(octyl)silane (OTS) and dichlorodimethylsilane (DCDMS).

11. The method of claim 1, wherein the silane-based coating solution further comprises a volatile solvent.

12. The method of claim 1, wherein the volatile solvent is hexane (C6H14).

13. The method of claim 11, wherein the silane-based coating solution comprises the silane-based compound in 0.1 part by weight or greater and the volatile solvent in 100 parts by weight.

* * * * *